US005498326A

United States Patent [19]

Galtier et al.

[11] Patent Number: 5,498,326

[45] Date of Patent: Mar. 12, 1996

[54] PROCESS FOR AND APPARATUS FOR CATALYTIC CRACKING IN TWO SUCCESSIVE REACTION ZONES

[75] Inventors: Pierre Galtier, Vienne; Régis Bonifay, Asnieres; Sigismond Franckowiak, Vienne; Thierry Gauthier, Saint Genis Laval; Renaud Pontier, Luzinay Vienne, all of France

[73] Assignee: Institut Francats du Petrole, Rueil Malmaison, France

[21] Appl. No.: 57,795

[22] Filed: May 7, 1993

[30] Foreign Application Priority Data

May 7, 1992 [FR] France ..... 92 05714

[51] Int. Cl.[6] ..... C106 51/02

[52] U.S. Cl. ..... 208/74; 208/72; 208/73; 208/75; 208/76; 208/77; 208/113; 208/148; 208/155; 208/156

[58] Field of Search ..... 208/72, 73, 74, 208/75, 76, 77, 113, 148, 155, 156

[56] References Cited

U.S. PATENT DOCUMENTS

| | | | |
|---|---|---|---|
| 2,307,879 | 1/1943 | Cornell | 208/74 |
| 3,607,730 | 9/1971 | Pfeiffer | 208/164 |
| 3,826,738 | 7/1974 | Zenz | 208/153 |
| 4,385,985 | 5/1983 | Gross et al. | 208/113 |
| 4,999,100 | 3/1991 | Thacker et al. | 208/113 |

FOREIGN PATENT DOCUMENTS

| | | |
|---|---|---|
| 539185 | 12/1955 | Belgium . |
| 0326478 | 8/1989 | European Pat. Off. . |

*Primary Examiner*—Sharon Gibson
*Assistant Examiner*—Walter D. Griffin
*Attorney, Agent, or Firm*—Millen, White, Zelano & Branigan

[57] ABSTRACT

The invention relates to a process for catalytic cracking and the associated apparatus in which the cracking reaction takes place in two substantially vertical and successive reaction zones, the loads being introduced into the first zone where it circulates from the top downwards, then at least a part of the product obtained is introduced into a second reaction zone in which it circulates in an ascending fashion. A supplementary hydrocarbonated phase is advantageously introduced into the product entering the second zone. The invention applies particularly to heavy loads, with a U-shaped apparatus.

19 Claims, 1 Drawing Sheet

PROCESS FOR AND APPARATUS FOR CATALYTIC CRACKING IN TWO SUCCESSIVE REACTION ZONES

BACKGROUND OF THE INVENTION

The present invention relates to a process for and an apparatus for the catalytic cracking of hydrocarbon loads.

It is known that in oil refineries, cracking processes are normally used in which the molecules of hydrocarbons of high boiling point and molecular weight are split into smaller molecules with a lower boiling point.

In the case of recent catalytic cracking processes, described for example in the patent EP-A-291253, the cracking reaction takes place in an elongate enclosure of substantially circular cross-section, the catalyst being admitted into the bottom part of the enclosure, together with the previously atomized hydrocarbon load. The establishment of contact between the load and the heated catalyst makes it possible to vaporize the hydrocarbons which then entrain the catalyst to the upper part of the reaction zone, the introduction of a propellant fluid assisting the ascending movement.

It is therefore necessary to vaporize the load appropriately in such processes. Indeed, if one is to obtain products of a cracking process which have a boiling point below that of the load, it would be prejudicial if this atomized load were to come in contact again with catalyst which has already given off a major part of its heat. Not only would the efficiency of the reaction be affected thereby but the retromixture of the catalyst would likewise produce additional coking.

Partly in order to limit these drawbacks, catalytic cracking processes have been conceived in which a reaction medium is used which follows a descending flow path. The catalyst is then introduced into the upper part of the reaction zone and the atomized hydrocarbon load is injected into the same part but in the descending flow of the catalyst (patent documents U.S. Pat. No. 4,385,985 and EP-A-254 333).

The product of reaction is then subjected to separation, for example in a cyclone, in order to obtain on the one hand, a gaseous hydrocarbon phase and, on the other, the catalyst. The catalyst is regenerated and then at least partially recycled to the cracking reactor.

These descending flow processes are satisfactory with regard to the reaction but using them poses problems. One drawback resides in the solid/gas separation by virtue of the substantial concentration of catalyst in the reaction medium, which requires specifically designed equipment if suitable efficiency is to be enjoyed. Furthermore, industrial installations generally comprise an ascending flow type of reaction chamber. The considerable and troublesome modifications to be made in order to change the direction of flow dissuade the use of these efficient processes.

SUMMARY OF THE INVENTION

A process and an apparatus are proposed which make it possible to employ a cracking reactor comprising one reaction zone with a descending flow followed by a reaction zone with an ascending flow, which makes it possible to gain the advantages both of an efficient reaction and of an improved solid/gas separation. Furthermore, such an apparatus may be installed on existing units at a cost below that entailed by modifications of the direction of flow.

To be more precise, the invention has as object a process for cracking hydrocarbon loads, the cracking reaction taking place in the presence of a catalyst in a moving or fluidized bed, the particles of catalyst being, after reaction, separated from the gaseous phase, regenerated and at least partly recycled, a process in which the cracking reaction takes place in two substantially vertical successive reaction zones, the load being introduced into the upper part of a first reaction zone then at least a part of the product obtained in the lower part of the first zone is introduced into a second reaction zone in which it circulates in an ascending fashion.

DETAILED DESCRIPTION OF THE DRAWINGS

Figure 1:
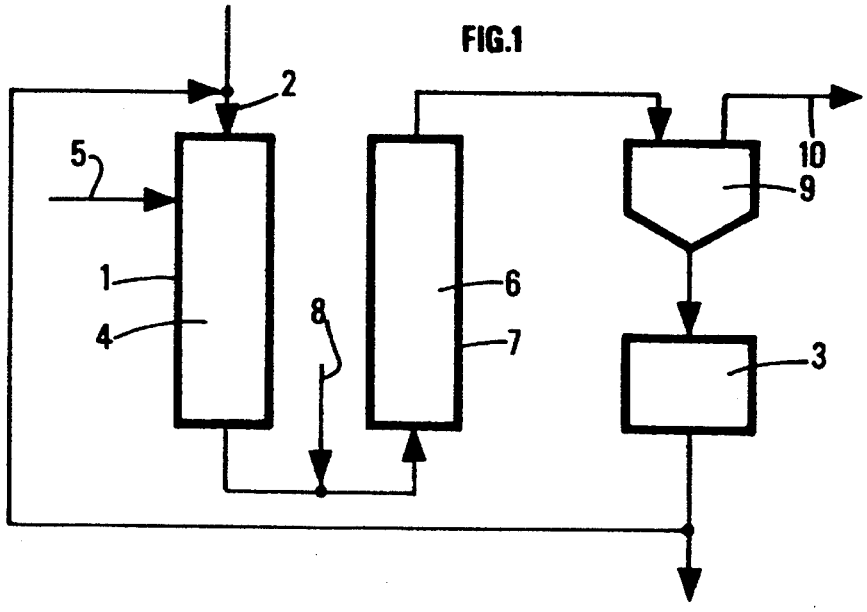
FIG. 1, without the invention being limited to this embodiment is a schematic flowsheet of the overall process of the invention.

The catalyst 2 which originates at least partly from the catalyst regenerator reactor 3 is introduced into the upper part of the tubular reactor 1, the axis of which is substantially vertical.

The rates of flow of catalyst particles between the reactor 3 and the first reaction zone 4 are adjusted by a pressure differential created for instance in a valve or by any other suitable means.

The catalyst enters at a rate in excess of 0.5 m/s and generally in excess of 1 m/s, possibly even as much as 20 m/s but more generally up to 5 m/s. The apparent volumetric mass of the catalyst in suspension is then approx. 50 to 600 kg/cu.m.

The load 5 previously heated to temperatures comprised between 100° and 250° C. is then brought into contact with the heated catalyst in a fluidized bed, in the form of fine droplets the diameter of which is generally comprised between 20 and 300 μ, most frequently obtained by known atomizing means.

The hydrocarbon loads to be treated are advantageously constituted by heavy hydrocarbons, that is to say those which have final boiling points of around 700° C. such as vacuum oils vacuum, but also heavier oils such as crude oil and vacuum residues. If necessary, these loads may have received prior treatment, for example a hydrotreatment in the presence of a Co—Mo type catalyst. Light loads may likewise be treated which have boiling points below 400° C.

The loads preferred for the process according to the invention contain fractions which normally boil at up to 700° C. or more, and which may contain high percentages of asphaltic products, Conradson carbon content possibly being as much as 4% or even more. These loads may possibly be mixed with lighter hydrocarbon fractions such as LCO and HCO.

Upon contact with the catalyst, the load vaporizes. It is then entrained by the current of catalyst with which it flows in a descending cocurrent in this first reaction zone (4) in which the cracking is partly performed (the rate of descending flow in the reactor varies and is more often than not comprised between 0.5 and 50 m/s and is preferably 0.5 to 10 m/s).

The product obtained in the bottom part of the first reaction zone (4) is transferred at least partly and preferably entirely to the bottom part of the second reaction zone (6) situated in the reactor (7) of substantially vertical axis.

This transfer must be carried out rapidly and the changes in the direction of flow must be controlled in such a way as to avoid sedimentation of the particles of the particles of catalyst. The invention likewise proposes suitable apparatus described hereinafter (U-tubes, inclined tubes . . . ).

The reaction medium flows in the second reaction zone in an ascending fashion at rates generally in excess of 2 m/s and possibly up to 50 m/s, but preferably comprised between 10 and 30 m/s.

To assist this flow, it is possible (but not compulsory) to introduce a propellant fluid into the bottom part of the second reactor (or close to this part, which is virtually the same). This fluid may be a naphtha or more generally a liquid with a boiling point below that of the load, which makes it possible to dispel the heat from the reaction zone. According to the invention, it is possible advantageously to introduce a hydrocarbon phase (8) into the reaction medium entering the second reaction zone.

Such introduction may be performed either in the bottom part of the second reaction zone into the medium entering this zone or a little upstream, thereof that is to say into the reaction medium during the course of transfer between the two reaction zones. The quantity of hydrocarbon phase introduced in relation to the quantity of load introduced into the first reaction zone represents from 0 to 50% and preferably 5 to 30% by weight.

The hydrocarbon phase may constitute by a part of the load to be treated. This may likewise be a light load, that is to say a load with a boiling point below 400° C. and more often approx. 180° C. to approx. 380° C.

The product obtained in the upper part of the reaction zone (6) is transferred to a means (9) for solid/gas separation in order to obtain, on the one hand, the gaseous phase (10) containing the products of cracking and, on the other hand, the catalyst.

The separated particles of catalyst are transferred to at least one regeneration reactor (3) where the coke is burned in conventional manner, then at least a part of the particles is recycled to the first reaction zone.

Here now it is possible to stress an essential advantage of the process according to the invention, which resides in the fact that the gas/solid separation is performed on a mixture which is more dilute in terms of catalyst. It is, for example, possible to reduce from 1.5 times to 2 times minimum the volumetric content of catalyst in the mixture entering the separator (9) by suitably injecting for instance from 20 to 40% by weight of light hydrocarbons (8) in relation to the load introduced at (5), in relation to the catalyst content of the mixture entering the separator if this is positioned in the bottom of the first reaction chamber (1). This makes it possible to achieve more efficient separation.

Another object of the invention is an apparatus for carrying out the catalytic cracking process on a hydrocarbon load according to the process which is the object of the invention. The apparatus is described with reference to FIGS. 2 and 3.

The apparatus comprises a first reactor (20) having a substantially vertical axis provided with means (21) of introducing catalyst into the upper part of the reactor, means (24) of introducing the atomized load to be treated into the upper part of the reactor. Means (24) is situated below the means (21) and the reactor is likewise provided with an aperture disposed in the bottom part of the reactor and on its axis, for discharge of the product obtained. The apparatus further comprises a second reactor (28) of substantially vertical axis provided in its bottom part with an aperture for the introduction of product obtained at the bottom part of the first reactor (20). Second reactor (28) is also provided in its upper part with a duct (29) for discharge of the product obtained following treatment in the second reactor. The apparatus likewise comprises at least one duct (30) connecting the bottom parts of the first and second reactors.

Thus, the apparatus comprises the two successive reactors (20) and (28) of substantially vertical axis, the bottom parts of which are connected by a duct (30).

The catalyst is introduced by means (21) consisting generally of a duct (22) fitted with a slide valve (23) disposed on the axis of the reactor.

The load to be treated is introduced in atomized form via means (24) generally constituted by a duct (25) fitted with atomizing means (26). This duct discharges below the aperture through which the catalyst is introduced in order to introduce the load into the catalyst with a descending motion.

The product obtained in the bottom part (27) of the first reactor is transferred to the second reactor through the duct (30).

For convenience, the drawings show reactors and duct (30) of virtually identical diameter but the invention is not limited to these forms of illustration.

The duct (30)—or possibly the ducts—must permit rapid transfer with minimal deposition of solid catalyst.

Figure 2:
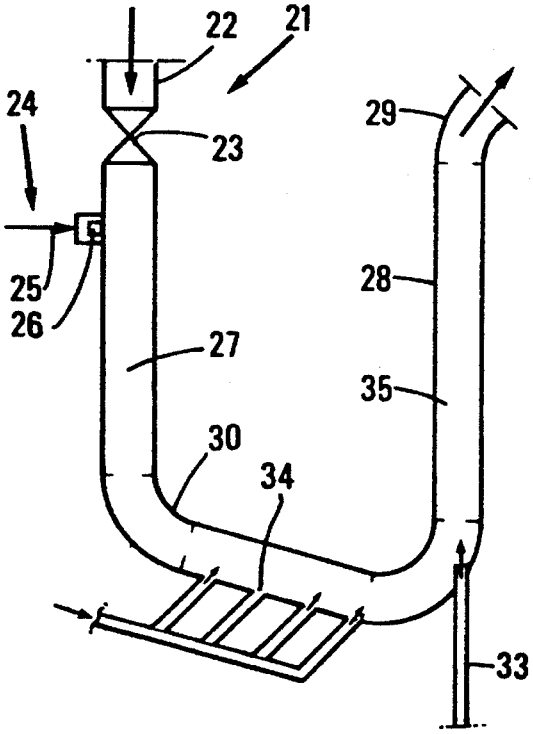
FIGS. 2 and 3 are partially schematic, isometric drawings of apparatuses associated with the said process.

The angled form shown in FIG. 2 is entirely suitable since it provides a U-shaped apparatus. The curvature, the distance between the two reactors, are then calculated so that the transfer takes place suitably within the conditions of the process.

Figure 3:
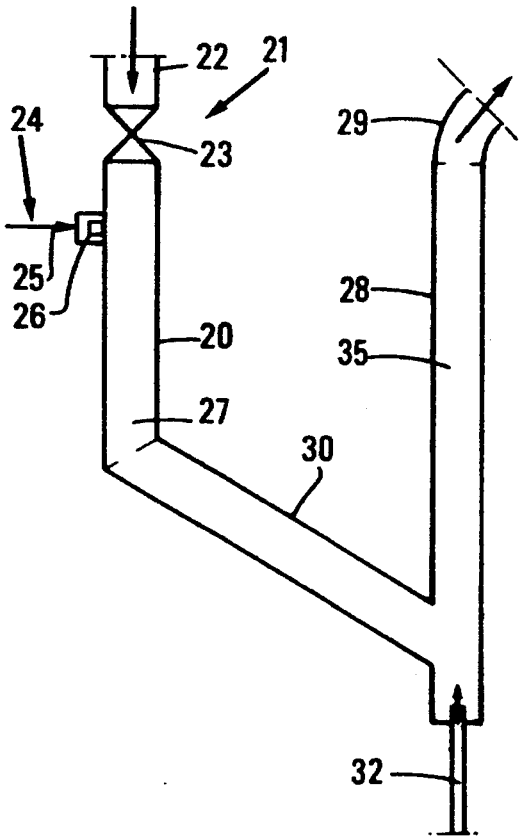

FIG. 3 illustrates a duct (30) which is inclined towards the second reactor, and transfer takes place by entrainment. This configuration is particularly interesting because it comes close to the current configuration of catalytic cracking processes, the load being injected, in the case of recent processes, most generally at (32). In these processes according to the prior art, the parts (20) and (30) are not then reaction zones and play a purely functional role in transporting the catalyst. It is possible to maintain in place in the part (28) one or more means (42) of injection-atomization of the hydrocarbon load which allows a hydrocarbon fraction which is to be converted possible to be injected into the ascending part.

The injection-atomization means may consist simply of a duct fitted with injection means and disposed for instance in the bottom part of the second reactor (duct (32) shown in FIG. 3) or close to this part. Preferably, the means comprise aerators (34) disposed on the duct (30) in such a way that management of injection follows the movement of the catalyst (substantially tangential injection). This embodiment makes it possible to reduce deposits substantially.

Obviously, the means cited may be combined.

The apparatus may likewise comprise in the bottom part of the second reactor (28) or close to it a duct (33) for introduction of a propellant fluid. This fluid may for example be a preferably liquid or gaseous hydrocarbon, water or an inert gas such as for example nitrogen.

The reaction medium (35) rises in the reactor (28), is evacuated therefrom, in the upper part, through a duct (29) to be directed to a gas/solid separator and a catalyst regenerating reactor. Via a duct connecting the reactor to the first cracking reactor, at least part of the catalyst is recycled.

We claim:

1. A process for cracking a hydrocarbon load, comprising:

contacting a hydrocarbon load with catalyst particles in a moving or fluidized bed, separating said catalyst particles after a cracking reaction from a gaseous phase, regenerating said catalyst particles, and at least partly recycling said catalyst particles, wherein said cracking reaction is conducted in two substantially vertical and successive reaction zones, in the first reaction zone, having a top portion and a bottom portion, said hydrocarbon load and said catalyst particles are introduced into said top portion, and said load flows from said top portion to said bottom portion of said first reaction zone, and at least a portion of the resultant product discharged from said bottom portion of said first zone is introduced as a reaction medium into the second reaction zone, wherein product flows upwardly, and wherein the descending flow rate of catalyst and entrained load in said first reaction zone is 0.5–50 m/s and wherein the ascending flow rate of reaction medium in said second reaction zone is 2–50 m/s.

2. A process according to claim 1, wherein all of said resultant product discharged from said first reaction zone is introduced into said second reaction zone.

3. A process according to claim 1, wherein said load which enters said top portion of said first reaction zone consists essentially of heavy hydrocarbons having a final boiling point of about 700° C.

4. A process according to claim 1, wherein said load which enters in said top portion of said first reaction zone consists essentially of light hydrocarbons with a boiling point below 400° C.

5. A process according to claim 1, wherein a hydrocarbon phase is introduced into said reaction medium entering said second reaction zone.

6. A process according to claim 5, wherein said hydrocarbon phase is identical to said load.

7. A process according to claim 5, wherein said hydrocarbon phase is a light phase with a boiling point below 400° C.

8. A process according to claim 7, wherein said hydrocarbon phase is a light phase with a boiling point of 180°–380° C.

9. A process according to claim 5, wherein the quantity of hydrocarbon phase introduced represents from 0 to 50% of the volume of said load introduced into said first reaction zone.

10. A process according to claim 9, wherein said quantity of hydrocarbon phase is 5 to 30% of said volume of said load.

11. A process according to claim 1, wherein a propellant fluid is introduced into the bottom part of said second reaction zone.

12. A process according to claim 1, wherein catalyst is introduced into said first reaction zone at a rate of 0.5–20 m/s.

13. A process according to claim 1, wherein the volumetric mass of catalyst in suspension is 50–600 kg/m$^3$.

14. A process according to claim 1, wherein prior to introduction into said first reaction zone, said load is preheated to 100°–250° C.

15. A process according to claim 1, wherein said load in the form of droplets having a diameter of 20–300 μm is brought into contact with catalyst in said first reaction zone.

16. A process according to claim 1, wherein the descending flow rate of catalyst and entrained load in said first reaction zone is 0.5–10 m/s.

17. A process according to claim 11, wherein said propellant fluid is a naphtha.

18. A process according to claim 1, wherein the ascending flow rate of reaction medium in said second reaction zone is 10–30 m/s.

19. A process according to claim 16, wherein the ascending flow rate of reaction medium in said second reaction zone is 10–30 m/s.

* * * * *